US009432770B2

(12) United States Patent
Nguyen et al.

(10) Patent No.: US 9,432,770 B2
(45) Date of Patent: Aug. 30, 2016

(54) METHOD AND DEVICE FOR LOCALIZING SOUND SOURCES PLACED WITHIN A SOUND ENVIRONMENT COMPRISING AMBIENT NOISE

(71) Applicant: CANON KABUSHIKI KAISHA, Tokyo (JP)

(72) Inventors: Eric Nguyen, Rennes (FR); Lionel Le Scolan, Rennes (FR)

(73) Assignee: CANON KABUSHIKI KAISHA, Tokyo (JP)

( * ) Notice: Subject to any disclaimer, the term of this patent is extended or adjusted under 35 U.S.C. 154(b) by 194 days.

(21) Appl. No.: 14/467,185

(22) Filed: Aug. 25, 2014

(65) Prior Publication Data

US 2015/0055797 A1 Feb. 26, 2015

(30) Foreign Application Priority Data

Aug. 26, 2013 (GB) ..... 1315182.4

(51) Int. Cl.
*H04R 3/00* (2006.01)

(52) U.S. Cl.
CPC ..... *H04R 3/005* (2013.01); *H04R 2430/20* (2013.01); *H04R 2430/23* (2013.01)

(58) Field of Classification Search
CPC H04R 3/005; H04R 1/406; H04R 2201/401; H04R 2430/20; H04R 2201/403; H04R 2203/12; H04R 2430/23; H04R 27/00; H04R 1/403; H04R 2201/405; H04R 2430/03; H04R 2430/25; H04R 3/02; H04R 3/04; H04R 3/12; H04B 10/1121; H04B 10/118; H04B 17/345; H04B 1/0458; H04B 1/38; H04B 7/0848; H04B 7/18515; G10L 2021/02166; G10L 15/20; G10L 21/0208; G10L 21/028; H04L 25/0204; H04M 1/67
USPC ..... 381/56–58, 94.1–94.4, 92, 71.11, 381/71.12, 356, 150; 704/270, 233, 273; 348/14.01–14.08
See application file for complete search history.

(56) References Cited

U.S. PATENT DOCUMENTS 6,999,593 B2 * 2/2006 Rui ..... G10L 21/0272 348/14.08
7,039,200 B2 * 5/2006 Rui ..... H04R 3/005 348/211.1

(Continued)

FOREIGN PATENT DOCUMENTS

EP 1273927 A1 1/2003

*Primary Examiner* — Lun-See Lao
(74) *Attorney, Agent, or Firm* — Canon USA, Inc. IP Division

(57) ABSTRACT

A method for localizing one or more sound sources of interest placed within a sound environment comprising ambient noise by estimating the directions of arrival (θ,ϕ) of said one or more sound source of interest comprising the steps of: calculating the environment steered response power (SRP (t, f, θ, ϕ)) corresponding to the steered response power of said one or more source of interest for one or more orientations using said environment audio signals; obtaining, using said array of at least two microphones, noise audio signals corresponding to the audio signals emanating from said sound environment under particular reference conditions; calculating a noise steered response power ($SRP_n$ (t, f, θ, ϕ)) corresponding to the steered response power of the ambient noise for said one or more orientations using said noise audio signals; and estimating the direction of arrival of said sound source of interest.

10 Claims, 7 Drawing Sheets

(56) References Cited

U.S. PATENT DOCUMENTS 7,308,105 B2 * 12/2007 Bullen ..... G01S 3/8083 381/57
8,159,902 B2 * 4/2012 Kim ..... H04R 3/005 367/127
8,233,352 B2 * 7/2012 Beaucoup ..... G01S 3/8083 367/119
2004/0190730 A1 9/2004 Rui et al.
2004/0240680 A1 12/2004 Rui et al.
2009/0279714 A1 11/2009 Kim et al.
2011/0038229 A1 2/2011 Beaucoup

* cited by examiner

METHOD AND DEVICE FOR LOCALIZING SOUND SOURCES PLACED WITHIN A SOUND ENVIRONMENT COMPRISING AMBIENT NOISE

CROSS-REFERENCE TO RELATED APPLICATION

This application claims the benefit of priority of United Kingdom patent application No. 1315182.4, filed 26 Aug. 2013, the entirety of which is hereby incorporated by reference.

BACKGROUND OF THE INVENTION

The present invention concerns a method and device for localizing sound sources.

The invention may be applied in the field of Sound Source Localization (SSL) which aims at determining the directions of sound sources of interest such as speech, music, or environmental sounds.

Said directions are called Direction Of Arrival (DOA).

SSL methods operate on audio signals recorded within a given angle search window and within a given time duration by a set of microphones, or microphone array.

To determine the DOAs, SSL algorithms usually restrict the search to a given angle search window.

The window can be defined based on the framing of the visual field of view when the array is coupled to visual means, e.g. a camera.

In general, only direct sounds are used to localize sound sources through the estimation of differences in intensities and time delays between received signals at each microphone in a microphone array.

Direct sounds correspond to the acoustic waves emanating from the sources and impinging the microphones through direct paths from sources to microphones.

When the sources are placed at a relatively large distance with respect to the dimensions of the array, the acoustic conditions are said to be far field.

In these conditions, only the time delay differences can be physically exploited.

These time delay differences, also known as Time Differences Of Arrival (TDOA) are usually expressed relatively to a given microphone of the array.

The TDOA depend on the DOA of each source and on the geometry of the microphone array.

The main issue for SSL methods is to cope with realistic acoustic conditions including reverberation associated to multipath acoustic propagation and background noise.

Most of the SSL methods in the art exploiting TDOA belong to the class of so-called angular spectrum methods.

An overview of said methods can be found in "Multi-source TDOA estimation in reverberant audio using angular spectra and clustering" Charles Blandin; Alexey Ozerov; Emmanuel Vincent, in Signal Processing, Elsevier, 2012, 92, pp. 1950-196.

In most SSL methods, the audio signal is captured by the microphone array, which is itself connected to a digital sound capture system including pre-amplification, analog to digital conversion and synchronization means.

The digital sound capture system thus provides a multi-channel set of recorded digital audio signals sharing the same sampling clock.

The SSL methods operate by first transforming the recorded signals in the time domain into time-frequency representations.

Then, a function of the DOA that is likely to exhibit large values for the true DOA $(\theta,\phi)$ of the sources and a low value otherwise for the observed signals is built for each bin (time interval and frequency interval couple).

Said function, which depends on both spatial direction dimensions and time, is called the local angular spectrum, after which the local angular method is named.

Then, integrating or pooling the local angular spectrum across the time-frequency plane is performed, i.e. the angular spectrum function is reduced to a function of only spatial direction dimensions.

As far the frequencies, most methods sum up the local angular spectrum values over frequencies.

As far the pooling over time frames in the Discrete Fourier Transform processing, different pooling operations can be applied.

Calculating the local angular spectrum is the core step of SSL methods.

As described in the aforementioned paper by Blandin et al, the following main classes of local angular spectrum functions can be defined:

- Generalized Cross Correlation (GCC) functions, such as in the so-called SRP-PHAT method as described in the paper "Robust localization in reverberant rooms", J. DiBiase, H. Silverman, and M. S. Brandstein, in Microphone Arrays: Signal Processing Techniques and Applications, pp. 131-154, Springer, 2001;
- variants of GCC-based functions defining a different frequency weighting at each frequency before integration over frequencies, as described in the paper, "Robust localization and tracking of simultaneous moving sound sources using beamforming and particle filtering", by J.-M. Valin, F. Michaud, and J. Rouat, in Robotics and Autonomous Systems, 55(3), pp. 216-228, 2007;
- subspace functions, such as in the MUSIC method as described, for instance, in the review paper "Two decades of Array Signal Processing research, the parametric approach", H. Krim, M. Viberg in IEEE Signal Processing Magazine, pp 67-94, July 1996; and
- beamforming functions also described in the aforementioned review paper by Krim et al.

As for beamforming functions, the traditional approach for SSL is to define the local angular spectrum function as the Steered Response Power (SRP) which estimates the power of the source in a given direction $(\theta,\phi)$, $\theta$ and $\phi$ being the angular spherical coordinates of a sound source.

Blandin et al. propose not to consider the SRP but rather a measure of the Signal to Noise ratio (SNR) of the audio source, defined by the ratio between the SRP of the source and the power of the noise, the power of the noise being defined as the difference between the total power minus the SRP of the source.

Assuming the noise being diffuse (istropic), Blandin et al. further proposes to define the local angular spectrum function as a weighted expression of the aforementioned SNR, i.e. the product of the SNR by a function depending upon the frequency having a closed-formed expression.

This is considered the best method published so far.

Although the aforementioned state-of-the-art methods perform reasonably well in some conditions, and in particular simulated conditions considering uncorrelated noise, it turns out that in some difficult real world conditions including ambient noise, the methods can fail in providing the right and/or complete SSL results.

Examples of ambient noise include air conditioning, electric devices, traffic, wind, hubbub (sources of no specific interest), electromagnetic interferences, etc.

Such ambient noise is generally "structured" in the sense that its angular spectrum is neither flat (isotropic, diffuse case) nor random but features directional characteristics.

Such structured noise can mask the sources of interest in the angular spectrum and hence jeopardize their detection and localization.

Typically, speech sources recorded outdoor in environment including strong electronic noise created by electromagnetic interference are particularly difficult to localize using the aforementioned methods, considering the electromagnetic noise has the effect of masking the sources of interest, hence providing inaccurate and/or false localization results.

More generally, the aforementioned SSL methods appear to be inaccurate and/or unreliable in any similar situation where sources of interest are placed within a sound environment comprising ambient noise sources that are close to sources of interest.

The problem is further difficult when considering compact size array devices considered in portable devices, e.g. when the distance between microphones typically not exceeds 20 cm (resulting in small TDOAs), when sources of interest are distant from the array (resulting in low SNR) and when sources of interest are close to each other (high resolution required).

The main reason behind the aforementioned problems is that Blandin et al. only consider reverberation as noise, and further assumes it as isotropic, i.e. independent from the direction of the noise.

Yet, in realistic environments, ambient noise can feature a very complex spatial covariance.

It is therefore preferable to account it directly in the model rather to rely on a theoretical model.

Generally, it is desirable to improve the performance of SSL methods in the aforementioned conditions.

BRIEF SUMMARY OF THE INVENTION

Accordingly, the present invention provides a method for localizing one or more sound sources of interest placed within a sound environment comprising ambient noise by estimating the directions of arrival $(\theta,\phi)$ of said one or more sound sources of interest comprising the steps of:

- obtaining, using an array of at least two microphones, environment audio signals corresponding to said one or more sources of interest and to the ambient noise emanating from said sound environment;
- calculating, using the environment audio signals, environment steered response powers (SRP $(t, f, \theta,\phi)$) corresponding each to the power of said sound environment for one orientation among a plurality of orientations;
- obtaining, using said array of at least two microphones, noise audio signals corresponding to the ambient noise emanating from said sound environment under particular reference conditions;
- calculating, using said noise audio signals, noise steered response powers ($SRP_n$ $(t, f, \theta, \phi)$) corresponding each to the power of said ambient noise for one orientation of the plurality of orientations; and
- estimating the direction of arrival of said sound source of interest by identifying, among said one or more orientations, a set of orientations using said source steered response power and said noise steered response power.

By calculating a noise steered response power based on noise audio signals emanating from the sound environment under particular reference conditions, the aforementioned method takes into account the contribution of the ambient noise, which depends on the direction, enabling accurate and reliable SSL in noisy conditions.

According to a particular embodiment, the reference conditions correspond to a situation where the sound sources of interest are inactive.

An inactive sound source corresponds to a sound source that emits no sound waves.

If the sound source is a loudspeaker or any other sound source that can be switched on or off, the inactive state may refer to the case where the sound source is switched off, or to the case if defined hereinbefore where it is switched on without emitting sound waves. Another example concerns the task of localizing sources in a public space. In this case, reference conditions correspond to the sound environment when no public is present, e.g. the sound environment in a museum before the opening to public.

According to a particular embodiment, the noise steered response power is calculated using the spatial covariance matrix of the ambient noise.

According to a preferred embodiment, the estimating step further comprises the steps of:

- calculating one or more environment Signal to Noise Ratio (SNR), corresponding to the ratio between the environment steered response power and the difference between the mean power of the environment audio signals minus the environment steered response power; and
- calculating an adjusted signal to noise ratio ($SNR_w$), corresponding to the difference between a weighted environment signal to noise ratio and the noise steered response power.

Weighting and subtracting the Signal to Noise Ratio by a quantity corresponding to the ambient noise that depends not only on the frequency but also on the direction greatly improves the localization of sound sources of interest which are masked by the structured ambient noise. This is especially the case when the sources of interest are close from each other.

According to a particular embodiment, the estimating step further comprises a step of identifying said set of orientations by selecting the local maximal values of the adjusted signal to noise ratio.

The adjusted signal to noise ratio being likely to exhibit large values for the true DOA $(\theta,\phi)$ of the sources and a low value otherwise for the observed signals is built for each time-frequency, the DOA of the sound sources of interest are thus obtained by determining the maxima of said adjusted signal to noise ratio.

According to a particular embodiment, the environment audio signals and the noise audio signals being recorded over given time durations and the steps of processing and calculating the adjusted SNRs being performed in a time-frequency domain, the adjusted SNR for each orientation are summed over all the frequencies of an operational frequency band and pooled over said time durations.

A typical operational range is to consider all frequencies but the first one.

The present invention also provides a device for localizing one or more sound sources of interest placed within a sound environment comprising ambient noise by estimating the directions of arrival $(\theta,\phi)$ of said one or more sound source of interest comprising:

obtention means, obtaining environment audio signals corresponding to said one or more sources of interest and to the ambient noise emanating from said sound environment using an array of at least two microphones, and obtaining noise audio signals corresponding to the ambient noise emanating from said sound environment under particular reference conditions;

calculation means calculating the environment steered response power (SRP (t, f, θ, ϕ)) corresponding to the power of said sound environment for one or more orientations using said environment audio signals, and calculating the noise steered response power ($SRP_n$ (t, f, θ, ϕ)) corresponding each to the power of the said ambient noise for said one or more orientations; and estimating the direction of arrival of said sound source of interest by identifying, among said one or more orientations, a set of orientations using said source steered response power and said noise steered response power.

According to a preferred embodiment, the calculation means calculate one or more environment signal to noise ratio (SNR), corresponding to the ratio between the environment steered response power and the difference between the mean power of the environment audio signals minus the environment steered response power and calculate an adjusted signal to noise ratio ($SNR_w$), corresponding to the difference between a weighted environment signal to noise ratio and the noise steered response power.

According to a preferred embodiment, the calculation means further comprise identification means identifying said set of orientations by selecting the local maximal values of the adjusted signal to noise ratio.

According to a preferred embodiment, the environment audio signals and the noise audio signals being recorded over given time durations, the calculation means calculate the adjusted SNRs in a time-frequency domain, the adjusted SNR for each orientation are summed over all the frequencies of an operational frequency band and pooled over said time durations.

BRIEF DESCRIPTION OF THE DRAWINGS

Embodiments of the invention will now be described, by way of example only, and with reference to the following drawings in which.

DETAILED DESCRIPTION OF DISCLOSED EMBODIMENTS

Figure 1:
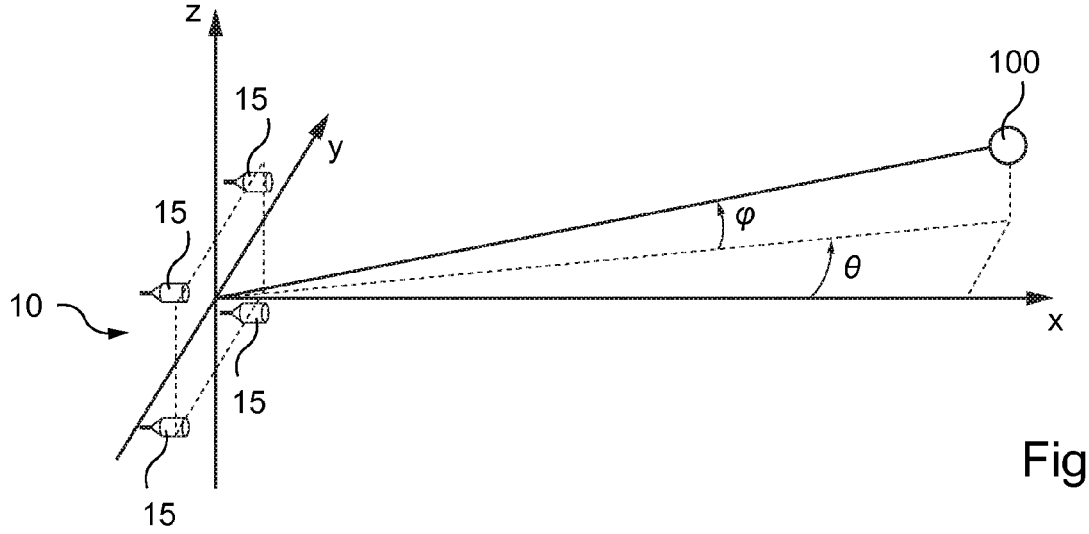
FIG. 1 is a graphical representation of a microphone array and sound source of interest according to a particular embodiment.

As illustrated on FIG. 1, a device for localizing one or more sound sources of interest according to a particular embodiment of the invention comprises a microphone array 10, which itself comprises four microphones 15.

The number of microphones within the array may vary, but at least three microphones are required to localize directions in 3D, that is, in both azimuth and elevation.

At least two microphones are required if a sound source is to be localized in a two dimensional area. In that case, a single angular variable defining the DOA is to be estimated, for example, azimuth only.

The method illustrated thereafter aims to localize directions in 3D, but can also be adapted to a 2D scheme.

Each microphone 15 of microphone array 10 records the audio signals emanating from a number of sound sources of interest 100 (only one is represented on FIG. 1) placed within a sound environment comprising ambient noise and located at a particular azimuth θ and elevation ϕ in spherical coordinates.

Figure 2:
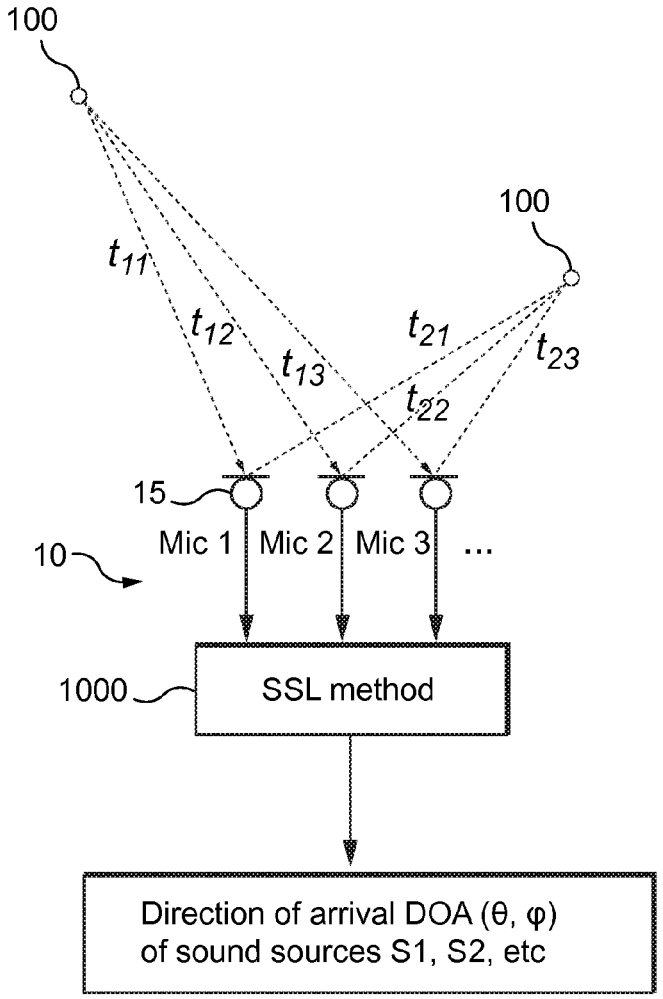
FIG. 2 is a graphical representation of differences in time delays between received signals at each microphone in the array of FIG. 1.

As shown on FIG. 2, the direct sound is used to localize the sound sources of interest 100 through the estimation of differences in intensities and time delays $t_{ij}$ between received signals at each microphone in the array. Direct sound can be defined as the acoustic waves emanating from the sound sources of interest 100 and picked up by microphones 15 through the most direct path from sound sources of interest 100 to microphones 15.

Sound Source Localization (SSL) 1000 is then performed in order to obtain the Direction of Arrival of sound sources of interest 100, and specifically their coordinates (θ,ϕ).

To do so, records will be exploited within given ranges of azimuth θ and elevation ϕ in spherical coordinates, i.e. within an angular search window $[\theta_{min},\theta_{max}]\times[\phi_{min},\phi_{max}]$, and within a given time duration T Under particular conditions called far field, corresponding to the situation when the sources are placed at a relatively large distance with respect to the dimensions of the array, only the time delay differences ($t_{11}$, $t_{12}$, $t_{13}$, $t_{21}$, $t_{22}$, $t_{23}$, etc) can be physically exploited.

These time delay differences, also known as Time Differences Of Arrival (TDOA) are usually expressed relatively to a given microphone 15 of the array 10.

Considering the TDOA depends on the Direction of Arrival DOA (θ,ϕ) of each source and on the geometry of the microphone array, and more specifically on the relative positions of the microphones, they are used to obtain the desired Direction of Arrival.

Figure 3:
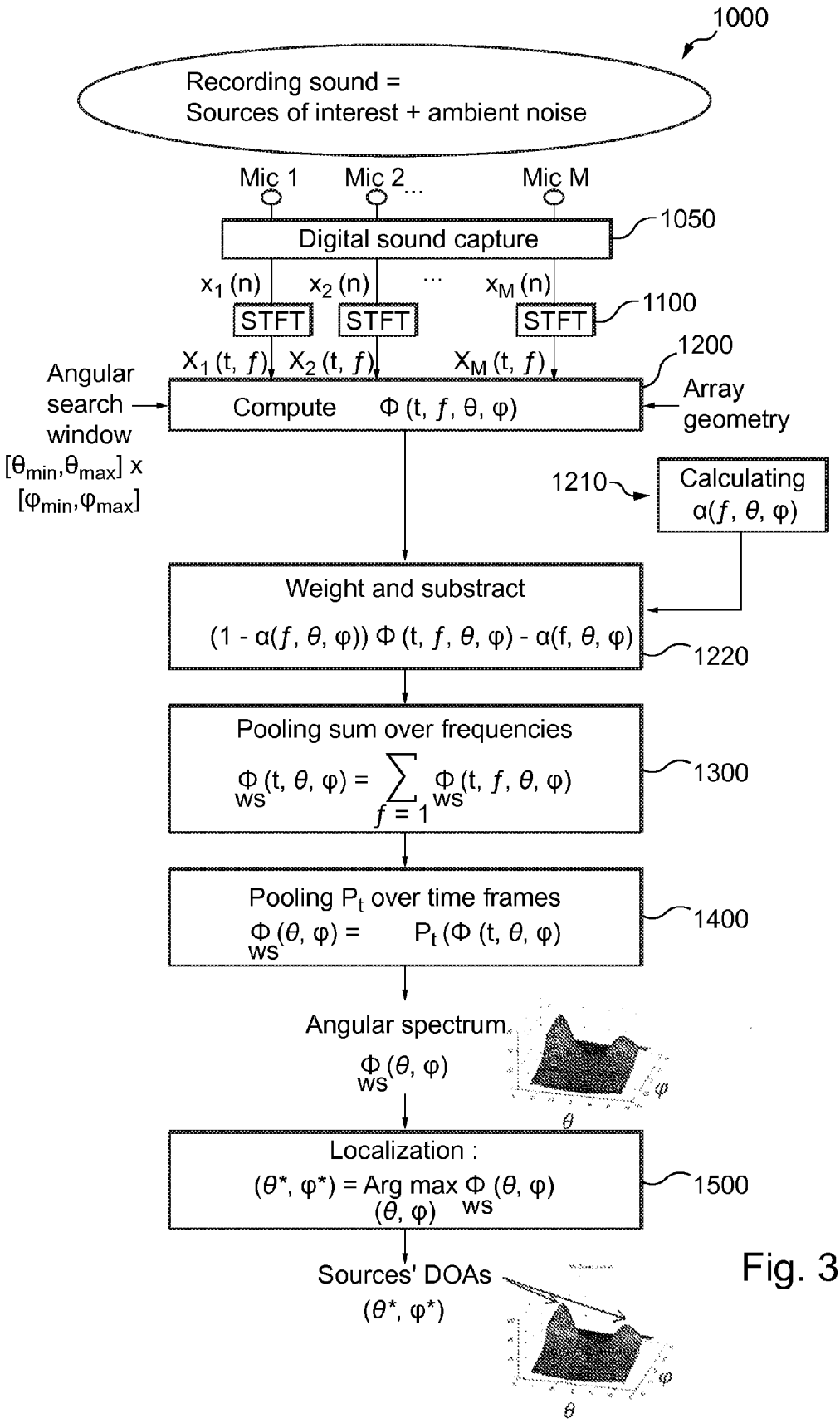
FIG. 3 shows a flowchart of a method for localizing one or more sound sources of interest according to a particular embodiment.

The Sound Source Localization 1000 according to a particular embodiment of the present disclosure is illustrated on FIG. 3.

First, a digital sound capture step 1050 is performed, during which environment audio signals, i.e. audio signals emanating from the sound environment, are captured by the microphone array 10.

Within this same step, microphone array 10 being connected to a digital sound capture system including pre-amplification, analog to digital conversion and synchronization means, a multichannel set of recorded digital audio signals $x_1(n), x_2(n), \ldots, x_M(n)$ sharing the same sampling clock, where M is the number of microphone and n the sampling time index, are obtained.

Next, a transforming step 1100 transforms the recorded signals in the time domain $x_i(n)$, i=1, . . . , M into time-frequency representations $X_i(t,f)$, i=1, . . . , M where (t, f) denotes the respective time and frequency indices.

Such a transforming step can be based on the Short Time Fourier Transform (STFT) that is used by most sound source localization algorithms.

In this case, t is the index of the time frame used in the Short Time Fourier Transform (STFT) processing.

Other transforms such as models of the human auditory front end (ERB, Equivalent Rectangular Bandwidth, transform) can be used.

Typically, when localizing speech source, sound is sampled at 16 000 Hz and STFT window size can be set to 1024 samples with 50% overlap considering a Hanning or sine window.

Then, a local angular spectrum building step 1200 is performed. A function of the DOA that is likely to exhibit large values for the true DOA (θ,ϕ) of the sources and a low value otherwise is computed for each time-frequency bin (t,f).

This function, called local angular spectrum function Φ(t,f,θ,ϕ), is built using TDOA information and thus inherently depends on the DOAs and on the array geometry.

It therefore depends on four variables: time t, frequency f, azimuth and elevation ϕ.

The local angular spectrum is usually computed for all discrete values of possible DOAs lying on a given grid (discrete set) of directions contained within the angular search window $[\theta_{min},\theta_{max}]\times[\phi_{min},\phi_{max}]$.

Assuming a predominant source in each time-frequency s (t, f) emanating from a direction corresponding to the azimuth and elevation (θ,ϕ), the time-frequency transformed recorded signals can be modeled as:

$$x(t,f)=a(f,\tau(\theta,\phi))s(t,f)+n(t,f) \tag{1}$$

where x(t,f) is the vector of size M composed of the STFT coefficients $X_i(t,f)$ of the recorded signals at each microphone, a(f,τ(θ,ϕ)) is the so-called steering vector associated with the direction (θ,ϕ), and n(t,f) is the vector accounting for "noise" terms with respect to the model.

The steering vector depends on the set τ(θ,ϕ) of TDOA $\tau_i(\theta,\phi)$, i=1, . . . , M which can be classically computed for each direction (θ,ϕ) assuming plane wave propagation.

The i-th component of the steering vector is given by:

$$a_i(f,\tau(\theta,\phi))=g_i(\theta,\phi)e^{-2i\pi f\tau_i(\theta,\phi)} \tag{2}$$

with $a_1(f,\tau(\theta,\phi))=1$ when the TDOAs $\tau_i(\theta,\phi)$ are expressed relatively to the first microphone and where $g_i(\theta,\phi)$ is related to the directivity of the microphone defined by the relative gain of the i-th microphone in the direction (θ,ϕ).

Assuming the microphone array is homogeneous with identical and omnidirectional microphones, then $g_i(\theta,\phi)=1$ for all microphones.

In the rest of the description we shall assume such a homogeneous array with omnidirectional microphones.

To build the local angular spectrum function, a known approach, based upon SNR-based beamforming local angular functions now considered as best state-of-the-art functions, can be used.

In the present embodiment of the invention, the proposed local angular function is a measure of the environment Signal to Noise Ratio (SNR), defined, for each time-frequency bin (t,f) and for each direction (θ,ϕ), by the ratio between the environment Steered Response Power SRP (t,f,θ,ϕ) in the direction (θ,ϕ), estimated from the recorded signals of the environment, and the power of the noise, where the power of the noise is defined as the difference between the total power minus the environment SRP.

This can be summarized by the following equation:

$$\Phi(t,f,\theta,\varphi)=\frac{SRP(t,f,\theta,\varphi)}{RP^{TOTAL}(t,f)-SRP(t,f,\theta,\varphi)} \tag{3}$$

where the total power $RP^{TOTAL}(t,f)$ is estimated as the mean power of the recorded signals over the number of microphones:

$$RP^{TOTAL}(t,f)=\frac{1}{M}\mathrm{trace}\left(\hat{R}_{xx}(t,f)\right) \tag{4}$$

where $\hat{R}xx(t,f)$ is the empirical covariance matrix of the signal.

Thus, the local angular spectrum function can be defined as:

$$\Phi(t,f,\theta,\varphi)=\frac{SRP(t,f,\theta,\varphi)}{\frac{1}{M}\mathrm{trace}\left(\hat{R}_{xx}(t,f)\right)-SRP(t,f,\theta,\varphi)} \tag{5}$$

The function is computed for all directions (θ,ϕ) of a discrete set (grid) contained in the given angular search window $[\theta_{min},\theta_{max}]\times[\phi_{min},\phi_{max}]$. This grid can be defined using uniform sampling.

The computation of the environment Steered Response Power SRP(t,f,θ,ϕ) is performed according to one of the two following embodiments:

according to a first embodiment, corresponding to DS beamforming (Delay-and-Sum beamformer, also known as Barlett beamformer), the following equation may be used as a basis for the calculation of the environment Steered Response Power:

$$SRP(t,f,\theta,\phi)=a(f,\tau(\theta,\phi))^H\hat{R}_{xx}(t,f)a(f,\tau(\theta,\phi))/M^2 \tag{6}$$

alternatively, according to a second embodiment of the invention, corresponding to MVDR beamforming (Minimum Variance Distortionless Response also known as Capon Beamformer) the following equation may be used as a basis for the calculation of the environment Steered Response Power:

$$SRP(t,f,\theta,\phi)=(a(f,\tau(\theta,\phi))^H\hat{R}_{xx}(t,f)^{-1}a(f,\tau(\theta,\phi)))^{-1} \tag{7}$$

The steering vectors a(f,τ(θ,ϕ)) are computed for each frequency f and each direction (θ,ϕ) and the empirical covariance matrices $\hat{R}_{xx}(t,f)$ estimated from the transformed data for each time-frequency bin.

$\hat{R}_{xx}(t,f)$ is also needed to compute the total energy in equation (4).

From the set of directions (θ,ϕ), the respective set of steering vectors a(f,τ(θ,ϕ)) is computed as defined by equation (2).

In this equation, the TDOAs $\tau_i(\theta,\phi)$ are computed as follows:

$$\tau_i(\theta,\varphi)=\frac{1}{c}k^T(\theta,\varphi)p_i \tag{8}$$

where:

$$k(\theta,\varphi)=\begin{bmatrix}\cos(\theta)\cos(\varphi)\\ \sin(\theta)\cos(\varphi)\\ \sin(\varphi)\end{bmatrix} \tag{9}$$

is the unit direction vector which defines the DOA (θ,ϕ) of the source normal to the plane waves in far field conditions, $p_i$ is the vector of 3D coordinates of the difference between the position of the first (reference) microphone and the position of the i-th microphone.

The empirical covariance matrix $\hat{R}_{xx}(t,f)$ is preferably estimated by a weighted moving averaging in the neighbourhood of each time frequency bin (t,f):

$$\hat{R}_{xx}(t,f)=\frac{\sum_{t',f'} w(t'-t,f'-f)\times(t',f')\times(t',f')^H}{\sum_{t',f'} w(t'-t,f'-f)} \tag{10}$$

where x(t,f) is the vector of size M composed of the STFT coefficients $x_i(t,f)$ of the recorded signals at each microphone, $(.)^H$ denotes the Hermitian (complex conjugate) transposition operator and w(t,f) is a time-frequency windowing function of length $L_f \times L_t$ defining the size and shape of the frequency and time neighbourhood.

As for w, rectangular windows or outer product of two Hanning windows can be used. As for $L_f$ and $L_t$, the common practice is to test all possible values and keep the ones giving the best performance results. Typically, for the parameters of the STFT defined above, the choice $L_f$=15 and $L_t$=5 provide good results.

During weighting and subtracting step 1220, the contribution of the ambient noise, which is structured (i.e. depends on the direction), is weighted and subtracted in the local angular spectrum function.

An adjusted signal to noise ratio (SNRw), corresponding to the difference between a weighted environment signal to noise ratio and the noise steered response power is calculated according to the following equation:

$$\Phi_{ws}(t,f,\theta,\phi)=(1-a(f,\theta,\phi))\Phi(t,f,\theta,\phi)-a(f,\theta,\phi) \tag{11}$$

which defines an improved local angular spectrum function $\Phi_{ws}(t,f,\theta,\phi)$ including weighting and subtracting operations applied to a given local angular spectrum function $\Phi_{ws}(t,f,\theta,\phi)$.

The quantity a(f,θ,ϕ) is a function of the structured spectrum of the noise, which depends not only on the frequency but also on the direction (θ,ϕ). The noise is here considered as stationary during the observation duration and hence does not depends on time t.

In the case of SNR-based beamforming local angular functions, DS or MVDR, the quantity a(f,θ,ϕ) corresponds to the normalized noise Steered Response Power:

$$a(f,\theta,\phi)=SRP_n(f,\theta,\phi) \tag{12}$$

The computation of the values a(f,θ,ϕ) is previously performed in noise steered response power computation step 1210.

Figure 4:
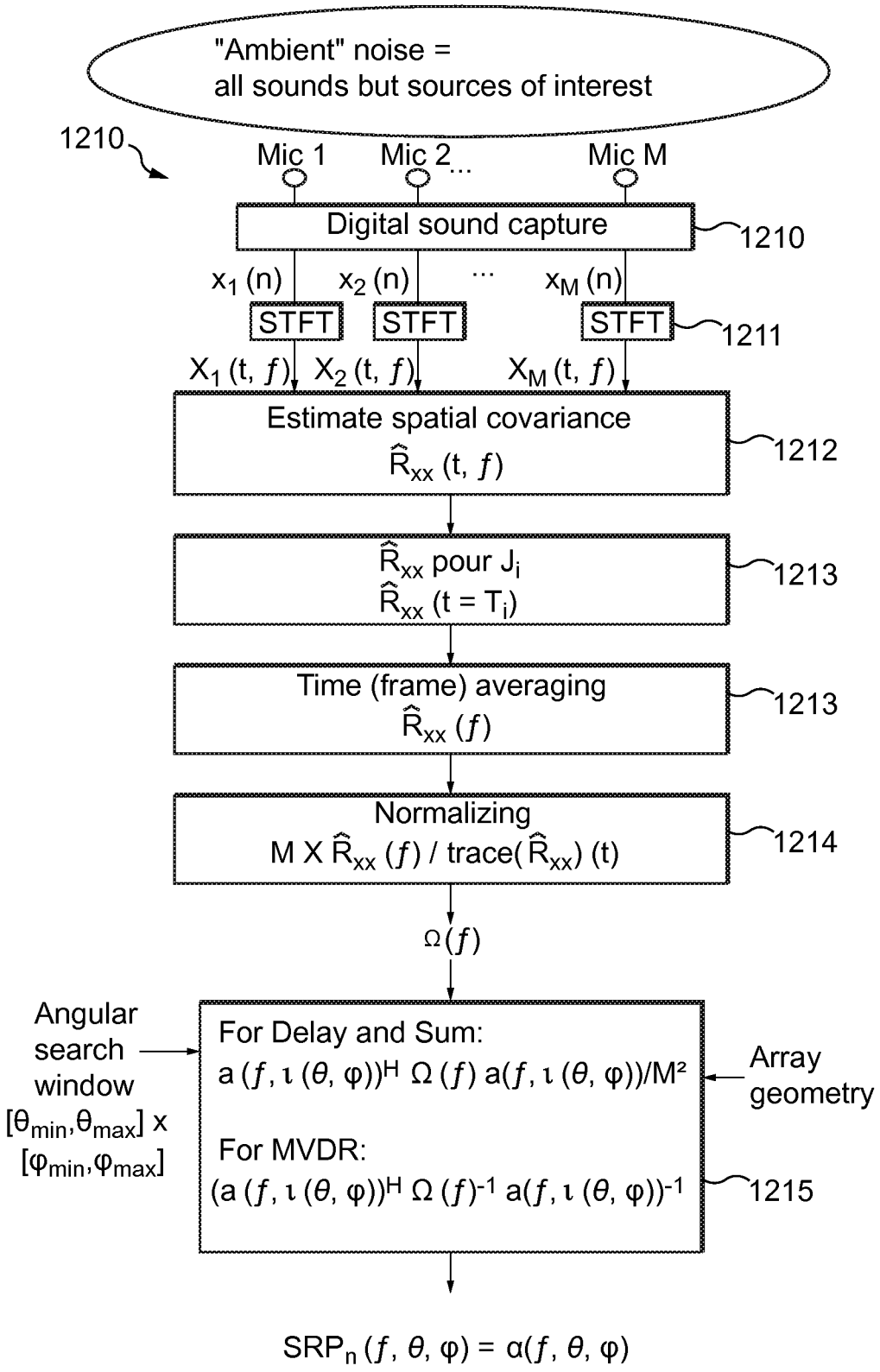
FIG. 4 shows a flowchart of a sub-steps of a step of the method shown on FIG. 2.

The sub-steps of noise steered response power computation steps 1210 are illustrated on FIG. 4.

A simple way to proceed to said computation is to consider pre-recordings of sounds when no sources of interest are active.

This operation should be supervised by a user that can judge that such conditions are satisfied.

For instance, when willing localizing sources in a public environment, the recordings of ambient noise will be performed before any public is in the environment, i.e. before opening.

The computation step 1210 starts by the STFT transform of the noise audio signals corresponding to the audio signals emanating from said sound environment under particular reference conditions in transformation step 1211, using the same parameters as the ones used for the signals in transforming step 1100.

The empirical spatial covariance of the ambient noise is then estimated in estimating step 1212 using the same moving averaging method described above using the same parameters.

Then, further assuming the noise is stationary, the estimated covariance matrices are averaged over time in averaging step 1213.

The resulting time-invariant spatial covariance of the noise $\hat{R}_{xx}(f)$ is then normalized in normalizing step 1214 in such a way that trace $(\hat{R}_{xx}(t))$=M to obtain the normalized spatial covariance of the noise Ω(f).

The computation of the noise steered response power a(f,θ,ϕ) is then performed according to one of the two following embodiments, depending upon to the one that was considered for the computation of the environment Steered Response Power SRP(t,f,θ,ϕ) as described before:

according to a first embodiment, corresponding to DS beamforming, the following equation may be used as a basis for the calculation of the noise Steered Response Power:

$$SRP_n(f,\theta,\phi)=a(f,\tau(\theta,\phi))^H\Omega(f)a(f,\tau(\theta,\phi))/M^2 \tag{13}$$

alternatively, according to a second embodiment of the invention, corresponding to MVDR beamforming the following equation may be used as a basis for the calculation of the noise Steered Response Power:

$$SRP_n(f,\theta,\phi)=(a(f,\tau(\theta,\phi))^H\Omega(f)^{-1}a(f,\tau(\theta,\phi)))^{-1} \tag{13}$$

Given the values of the noise steered response power a(f,θ,ϕ), the weighing and subtracting step 1220 may be performed.

Further processing to complete the SSL method including integration over frequencies, pooling over time and peak detection is performed considering the improved local angular function $\Phi_{ws}(t,f,\theta,\phi)$ as input.

During these steps, integration or pooling of the improved local angular spectrum across the time-frequency plane is performed to reduce the local angular spectrum to a spatial function $\Phi_{ws}(\theta,\phi)$, called the angular spectrum, of only spatial direction dimensions. The DOAs are to be estimated from this angular spectrum.

The pooling is done in two consecutive steps: an integrating (pooling) over frequencies step 1300, and a pooling over time frames step 1400.

As for the integration over frequencies step 1300, in order to mitigate the effect of spatial aliasing occurring at high frequencies, most methods sum up the local angular spectrum values over frequencies.

In turn, during the pooling over time frames 1400, different pooling operators $P_t$ can be applied.

Alike frequencies, integration over time can be performed by summing up the spectrum over time frames according to the following equation:

$$\Sigma^{T}_{t=1}\Phi(t,\theta,\phi). \quad (15)$$

An alternative is to take instead the maximum over all time frames.

Yet another alternative is to build an histogram by counting occurrences of peaks in $\Phi_{ws}(t,\theta,\phi)$ for each direction over frames.

Finally, at localizing step 1500, localizing the direction of the sound sources is performed by searching for the highest peaks of the pooled angular spectrum $\Phi_{ws}(\theta,\phi)$.

FIGS. 5*a-b* and 6*a-b* illustrate the advantages of the method according to the present invention over state-of-the-art methods and especially the original weighted version of the SNR-based beamforming local angular function proposed by Blandin et al.

Said figures correspond to the results obtained by the two methods from recordings were performed outdoor in a noisy environment including strong electronic noise created by electromagnetic interference due to unshielded cabling set-up.

Two speech sources were active during the observation period of 5 seconds.

Sources were close to each other at respectively −8° and −4° azimuth and at around 8° elevation for both and placed at 5 m from an 8-microphone array, i.e. in far-field conditions.

Figure 5A:
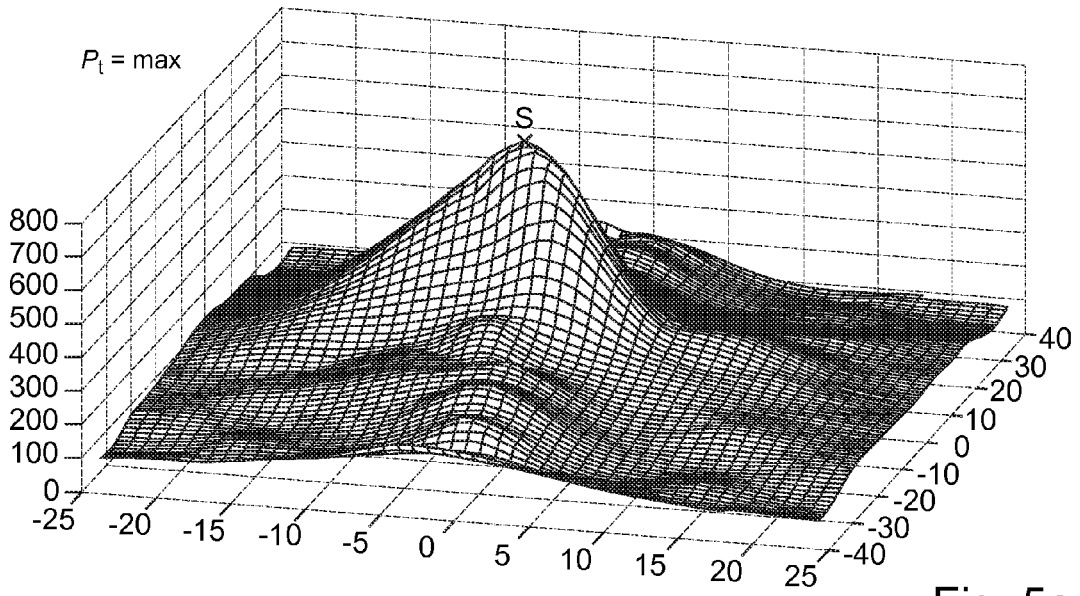
FIG. 5*a* is a graphical representation of an angular spectrum using a maximum pooling function obtained with state-of-the art sound localization methods computed from signals emanating from an environment comprising two sound sources of interest and ambient noise.

As it can be seen in FIG. 5*a*, the state-of-the-art method could not properly differentiate the two sources: the angular spectrum obtained using the max pooling results in a single dominant peak located at −3° azimuth and 6° elevation.

Figure 5B:
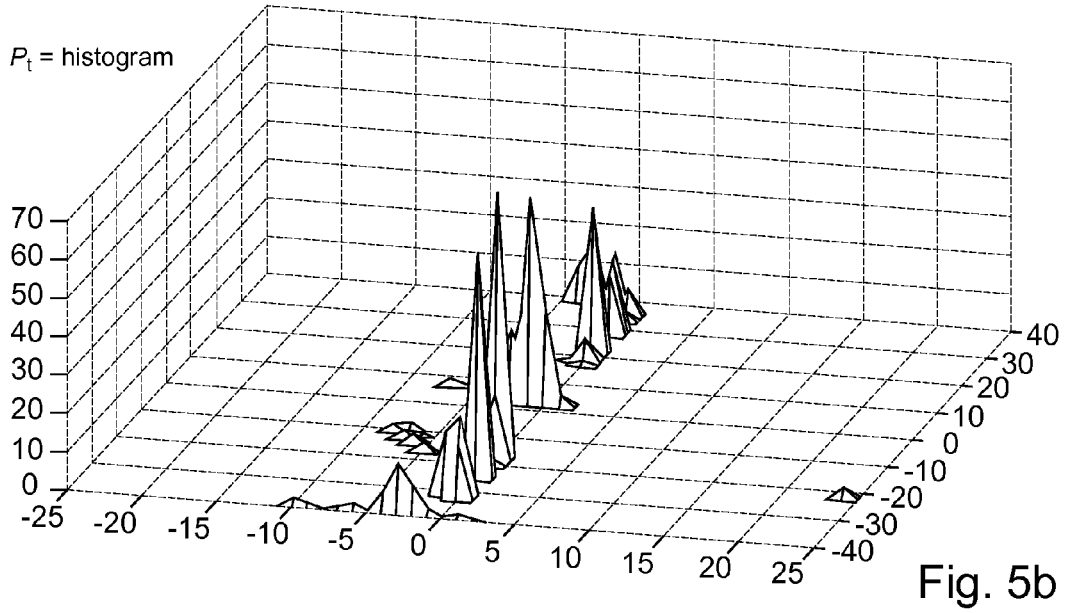
FIG. 5*b* is a histogram corresponding to the output of the angular spectrum of FIG. 5*a* using a different pooling function.

In addition, the histogram pooling represented in FIG. 5*b* reveals peaks aligned along the 0° azimuth.

The reason is that the electromagnetic noise created spatial correlation along the (0,0) direction which corresponds to TDOA=0 because of the electromagnetic waves travelling at the speed of light.

This has the effect of masking the sources of interest in the angular spectrum, hence providing inaccurate and/or false localization results.

Figure 6A:
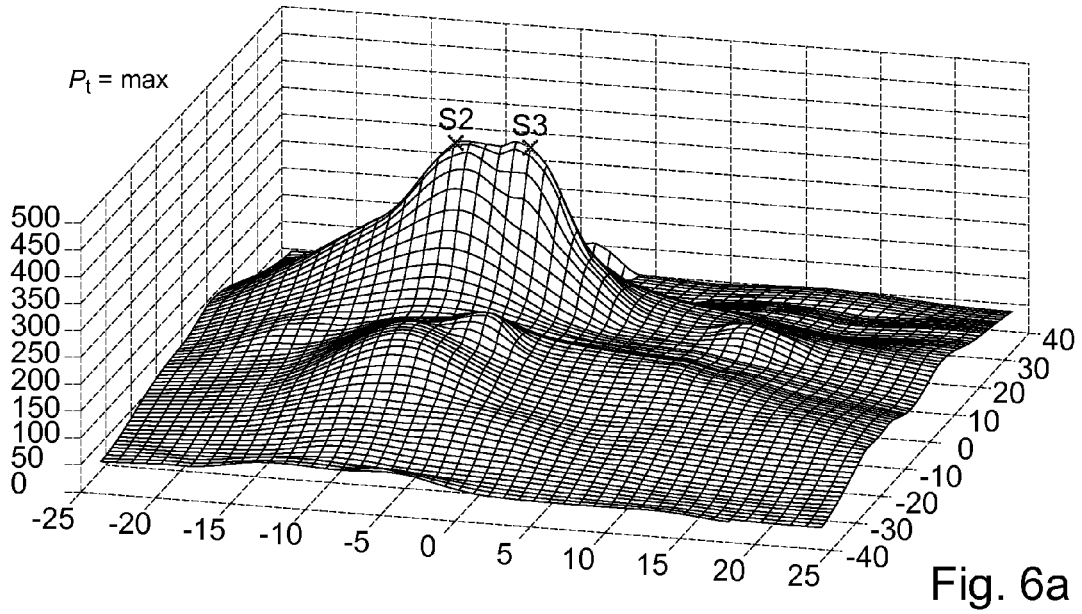
FIG. 6*a* is a graphical representation of an angular spectrum obtained with a sound localization method according to an embodiment computed from signals emanating from the same environment as FIG. 5*a*.
Figure 6B:
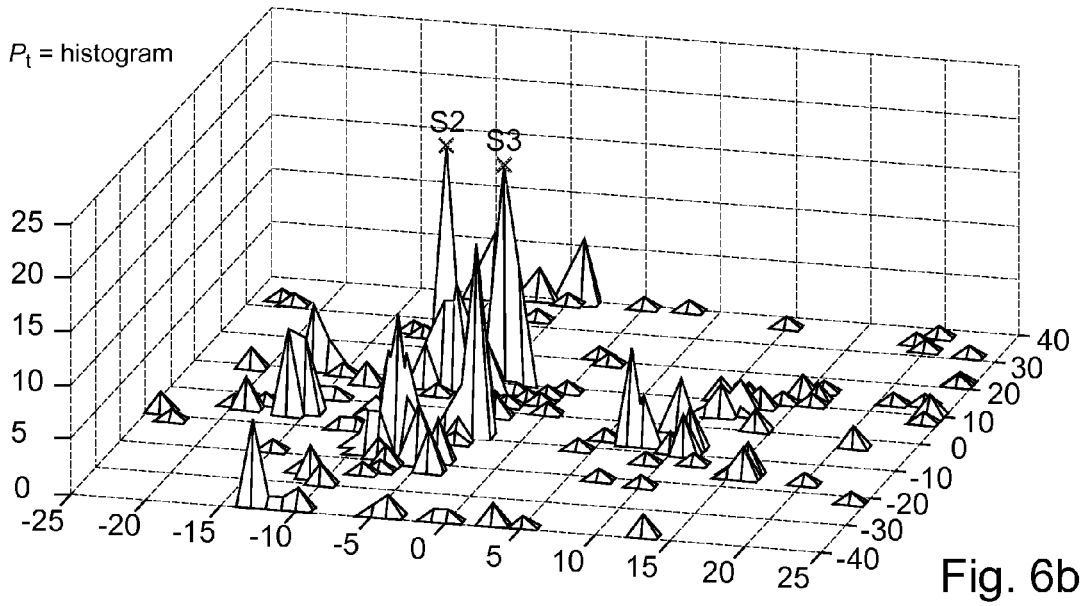
FIG. 6*b* is a histogram corresponding to the output of the angular spectrum of FIG. 6*a* using a different pooling function.

In turn, as it can be observed on FIGS. 6*a* and 6*b*, two peaks can be differentiated.

In addition, the normalized angular spectrum of the noise at the right hand side of FIG. 6*a* is indeed structured with peaks aligned along the 0° azimuth.

By weighting and subtracting operations, the two sources can then be revealed from the original spectrum.

In the preceding description, ambient noise was assumed to be stationary, resulting in the fact that the time-frequency spatial covariance matrix Ω(f) could be considered as time-independent.

However, under particular conditions, ambient noise characteristics may vary over time.

To deal with such situations, an alternative embodiment of the present invention uses an adaptive scheme where localization results obtained over a time duration T are used to estimate a new time-frequency spatial covariance matrix Ω(f) for the next time duration T.

Figure 7:
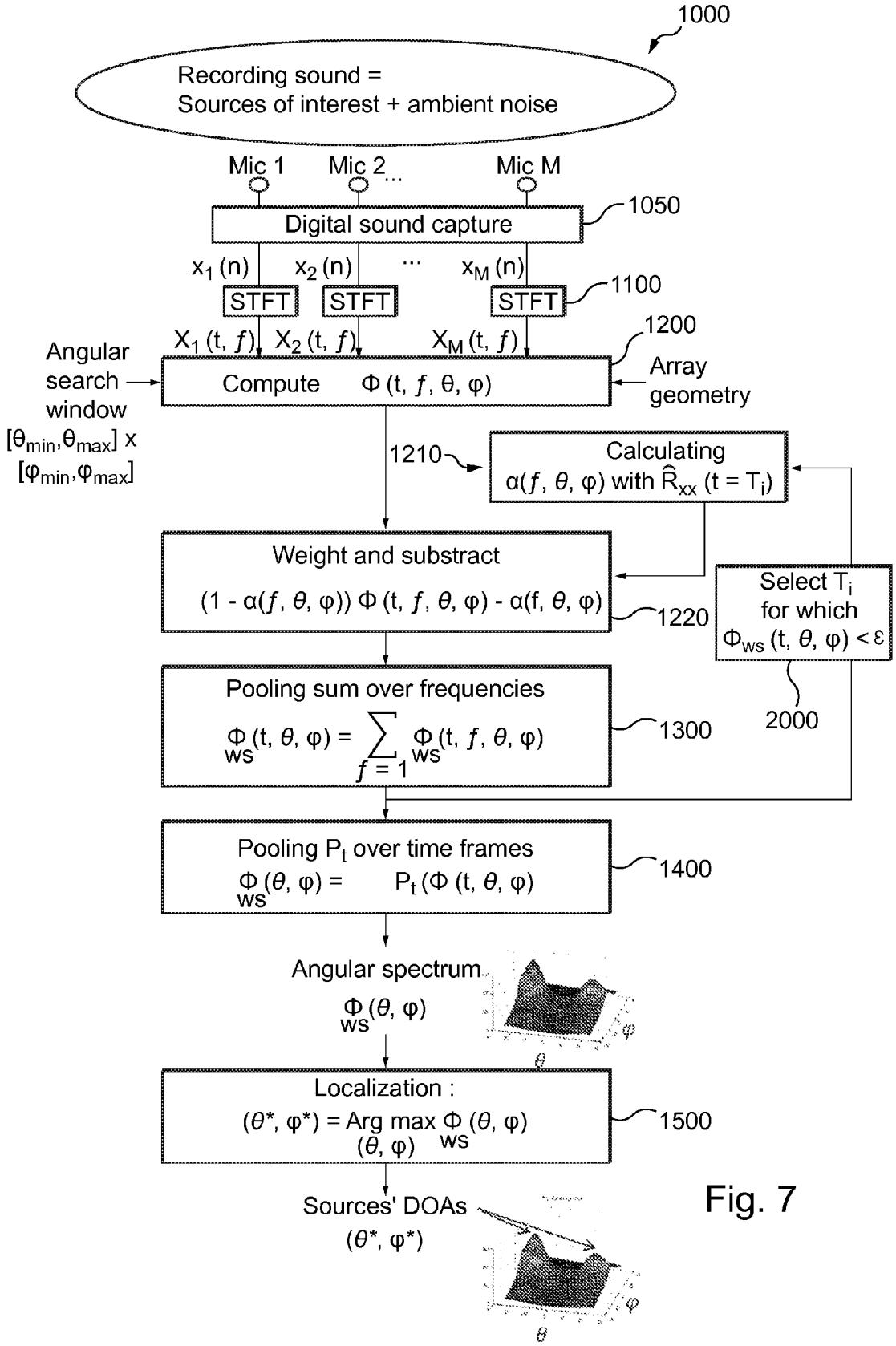
FIG. 7 shows a flowchart of a method for localizing one or more sound sources of interest according to another embodiment.

To do so, as illustrated on FIG. 7 (corresponding to FIG. 3 in which step 2000 has been added), instead of using the ambient noise under reference conditions (such as the sound sources being inactive) as the input for the calculation of the steered noise response power $a(f,\theta,\phi)=SRP_n(f,\theta,\phi)$ performed at transformation step 1211, the calculation of the time-frequency spatial covariance matrix Ω(f) begins with the averaging of spatial covariance matrices $\hat{R}xx(T_i,f)$ for specific time frames $T_i$ where, for all given localized directions, within all of these frames, all sources of interest are weak or inactive.

Specific time frames T, are selected during an additional threshold selection step 2000.

Figure 8:
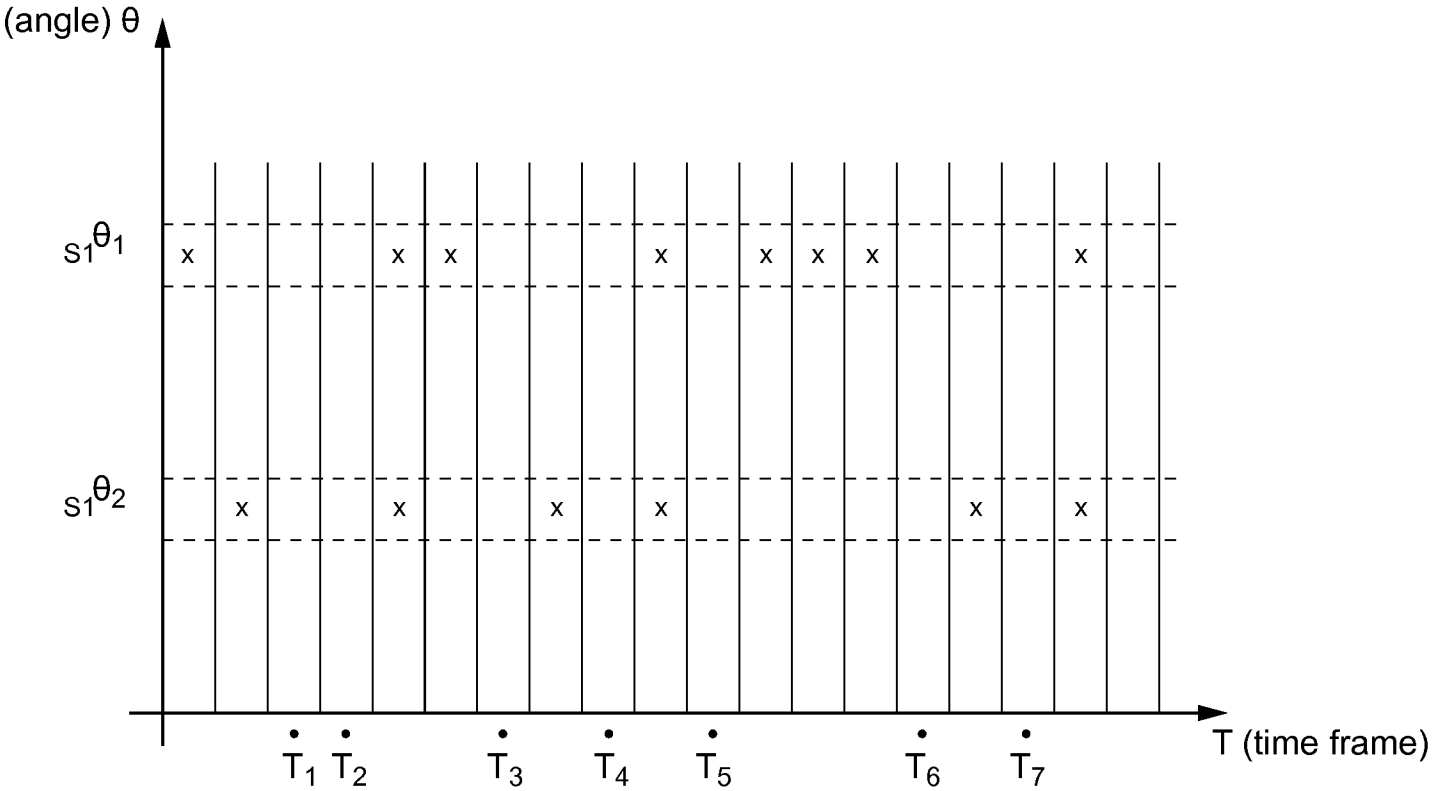
FIG. 8 shows an example of how the selection of the time frames is performed during threshold selection.

An example of how the selection of the time frames is performed during threshold selection step 2000 is illustrated on FIG. 8.

Considering two sound sources of interest $S_1$, and $S_2$, located at an angle $\theta_1$, and $\theta_2$, threshold selection will consist in selecting the time frames $T_1$, $T_2$, $T_3$ . . . $T_7$ where the values of $\Phi_{ws}$ (t, θ, ϕ) are under the value ϵ of a predetermined threshold, indicating the sound sources identified at $\theta_1$ and $\theta_2$ are considered very weak or inactive.

Once the values of specific time frame T, are known, a calculating step 1210' is performed, where the input given to averaging step 1213, i.e. the spatial covariance matrices to be averaged, are the spatial covariance matrices at selected times frames $T_i$, i.e. $\hat{R}_{xx}(T_i,f)$.

Although the present invention has been described hereinabove with reference to specific embodiments, the present invention is not limited to the specific embodiments, and modifications will be apparent to a skilled person in the art which lie within the scope of the present invention.

Many further modifications and variations will suggest themselves to those versed in the art upon making reference to the foregoing illustrative embodiments, which are given by way of example only and which are not intended to limit the scope of the invention, that being determined solely by the appended claims. In particular the different features from different embodiments may be interchanged, where appropriate.

In the claims, the word "comprising" does not exclude other elements or steps, and the indefinite article "a" or "an" does not exclude a plurality.

The mere fact that different features are recited in mutually different dependent claims does not indicate that a combination of these features cannot be advantageously used.

The invention claimed is:

1. A method for localizing one or more sound sources of interest placed within a sound environment comprising ambient noise by estimating the directions of arrival (θ, ϕ) of said one or more sound sources of interest, comprising the steps of:

obtaining, using an array of at least two microphones, environment audio signals corresponding to said one or more sources of interest and to the ambient noise emanating from said sound environment;

calculating, using the environment audio signals, environment steered response powers (SRP (t, f, θ, ϕ) corresponding each to the power of said sound environment under particular reference conditions;

obtaining, using said array of at least two microphones, noise audio signals corresponding to the ambient noise emanating from said sound environment under particular reference conditions;

calculating, using said noise audio signals, noise steered response powers ($SRP_n$ (t, f, θ, ϕ) corresponding each to the power of said ambient noise for one orientation of the plurality of orientations; and estimating the direction of arrival of said sound source of interest by identifying, among said one or more orientations, a set of orientations using said source steered response power and said noise steered response power.

2. The method according to claim 1, wherein the reference conditions correspond to a situation when the sound sources of interest are inactive.

3. The method according to claim 1, wherein the noise steered response power is calculated using the spatial covariance matrix of the ambient noise.

4. The method according to claim 1, wherein the estimating step further comprises the steps of:

calculating one or more environment signal to noise ratio (SNR), corresponding to the ratio between the environment steered response power and the difference between the mean power of the environment audio signals and the environment steered response power; and calculating an adjusted signal to noise ratio ($SNR_w$), corresponding to the difference between a weighted environment signal to noise ratio and the noise steered response power.

5. The method according to claim 1, wherein the estimating step further comprises a step of identifying said set of orientations by selecting the local maximal values of the adjusted signal to noise ratio.

6. The method according to claim 4, the environment audio signals and the noise audio signals being recorded over given time durations and the steps of processing and calculating the adjusted signal to noise ratios (SNRs) being performed in a time-frequency domain, wherein the adjusted signal to noise ratio (SNR) for each orientation are summed over all the frequencies of an operational frequency band and pooled over said time durations.

7. A device for localizing one or more sound sources of interest placed within a sound environment comprising ambient noise by estimating the directions of arrival ($\theta,\phi$) of said one or more sound source of interest, comprising:

obtaining means obtaining environment audio signals corresponding to said one or more sources of interest and to the ambient noise emanating from said sound environment using an array of at least two microphones, and obtaining noise audio signals corresponding to the ambient noise emanating from said sound environment under particular reference conditions;

calculation means calculating the environment steered response power (SRP ($t, f, \theta, \phi$)) corresponding to the power of said sound environment for one or more orientations using said environment audio signals, and calculating the noise steered response power (SRPn ($t, f, \theta, \phi$)) corresponding each to the power of the said ambient noise for said one or more orientations; and estimating means estimating the direction of arrival of said sound source of interest by identifying, among said one or more orientations, a set of orientations using said source steered response power and said noise steered response power.

8. The device according to claim 7, wherein the calculation means calculate one or more environment signal to noise ratio (SNR), corresponding to the ratio between the environment steered response power and the difference between the mean power of the environment audio signals minus the environment steered response power and calculate an adjusted signal to noise ratio ($SNR_w$) corresponding to the difference between a weighted environment signal to noise ratio and the noise steered response power.

9. The device according to claim 7, wherein the calculation means further comprise identification means identifying said set of orientations by selecting the local maximal values of the adjusted signal to noise ratio.

10. The device according to claim 8, the environment audio signals and the noise audio signals being recorded over given same time durations, wherein the calculation means calculates the adjusted SNRs in a time-frequency domain, and wherein the adjusted SNR for each orientation are summed over all the frequencies of an operational frequency band and pooled over said time durations.

* * * * *